United States Patent [19]

Kishino et al.

[11] Patent Number: 4,899,081

[45] Date of Patent: Feb. 6, 1990

[54] FLUORESCENT DISPLAY DEVICE

[75] Inventors: Takao Kishino; Minoru Katayama; Kazuyuki Yano; Isao Ohtsuka, all of Mobara, Japan

[73] Assignee: Futaba Denshi Kogyo K.K., Mobara, Japan

[21] Appl. No.: 252,052

[22] Filed: Sep. 30, 1988

[30] Foreign Application Priority Data

Oct. 2, 1987 [JP] Japan ..... 62-250392

[51] Int. Cl.[4] ..... H01J 63/02

[52] U.S. Cl. ..... 313/496; 313/497

[58] Field of Search ..... 313/496, 497, 495

[56] References Cited

U.S. PATENT DOCUMENTS 4,542,317 9/1985 Morimoto et al. ..... 313/496

4,763,041 8/1988 Segawa ..... 313/497 X

*Primary Examiner*—Kenneth Wieder

*Attorney, Agent, or Firm*—Oblon, Spivak, McClelland, Maier & Neustadt

[57] ABSTRACT

A fluorescent display device capable of eliminating a display defect and exhibiting high luminance to improve quality of a luminous display and provide the display with good visibility. The fluorescent display device is the plane grid type and includes, in place of mesh-like grids, plane grids of a three-layer structure comprising metal film sections, insulating layer sections and conductive layer sections.

3 Claims, 3 Drawing Sheets

FLUORESCENT DISPLAY DEVICE

BACKGROUND OF THE INVENTION

1. Field of the Invention

This invention relates to a fluorescent display device, and more particularly to an improvement in a fluorescent display device which has been conventionally used for household appliances such as an audio system, a VTR, an electronic oven and the like.

2. Description of the Prior Art

A fluorescent display device has been recently used in various fields as well as for household appliances. For example, it is often mounted on a vehicle for the purpose of being used for a speedmeter, a tachometer, an oil indicator and the like arranged on an instrument panel of the vehicle.

Display units used for meters mounted on a vehicle include a direct-reading type display unit wherein a luminous display of a fluorescent display device mounted on an instrument panel provided at a dashboard of the vehicle is directly observed and a so-called head up display unit as disclosed in Japanese Pat. Application Laying-Open Publication No. 182541/1982 and the like wherein a luminous display of a fluorescent display device arranged in a dashboard is reflected from a front glass of a vehicle to form an image of the display in a visual field in front of the front glass, so that a driver may observe an information without averting his eyes from the front glass.

The present invention is directed to a fluorescent display device of high luminance which is also used for the head up display unit.

The head up display unit, as described above, is so constructed that a luminous display of a fluorescent display device arranged in a dashboard is reflected from a front glass of a vehicle to form an image of the display in a visual field in front of the front glass. Accordingly, it is widely known that the head up display unit is deteriorated in visibility in the daytime wherein it is light outside, unless it exhibits high luminance as compared with the conventional direct-reading type display unit.

In order to avoid such a problem, a fluorescent display device to be used for the head up display unit is required to exhibit higher luminance.

A conventional fluorescent display device is generally constructed in such a manner that a wiring pattern and anode conductors each are formed of a conductive material on a glass substrate and phosphor layers are deposited on the anode conductors, resulting in formation of anodes. The fluorescent display device also includes mesh-like grids arranged above the anodes and filamentary cathodes stretched above the grids, so that electrons emitted from the filamentary cathodes are impinged on the phosphor layers while being accelerated and controlled by the mesh-like grids, to thereby cause the phosphor layers of the anodes to emit light. Accordingly, luminescence of the anodes is observed through the mesh-like grids and a transparent front cover. Unfortunately, such construction causes the mesh-like grids to reduce luminance of the anodes.

In order to minimize such a problem, a plane grid structure free of any mesh-like grid as shown in FIG. 4 was proposed for a fluorescent display device. More particularly, the plane grid structure includes a glass substrate 1 and wiring conductors 2 formed on the glass substrate 1 by depositing an Ag paste on the glass substrate by thick film printing. On the wiring conductors 2 is formed an insulating layer 4 provided with throughholes 3 by thick film printing. Also, the structure includes anode conductors 5 and plane grids 6 arranged on the insulating layer 4 in a manner to be electrically connected to the wiring conductors 2 via the throughholes 3. The anode conductors 5 and plane grids 6 are formed of a conductive graphite paste into the same height by thick film printing. Then, on the anode conductors 5 are deposited phosphor layers 7, which form anodes 8 in cooperation with the anode conductors 5. Above the so-formed anodes 8 are stretchedly arranged filamentary cathodes 10. Thus, the fluorescent display device of the plane grid type is constructed into a laminated structure by thick film printing. Accordingly, a failure in formation of a gap of 0.2mm or more between the anode conductors 5 and the plane grids 6 has a possibility of causing short-circuit to occur between the anode conductors 5 and plane grids 6 due to sagging of the paste used for forming the anode conductors and plane grids or depending on accuracy of the thick film printing. Also, in the conventional fluorescent display device of this type, when a width of each of the grids 6 required to insure accuracy of the printing and function of the grid is set to be at least 0.5mm and a gap between an end of the anode conductor 5 and the phosphor layer 7 is set to be 0.2mm, it is required to provide a gap S of 1.0mm or more between phosphor patterns of adjacent luminous segments. This causes the gap S between the segments to be enlarged to a degree sufficient to deteriorate continuity of figures displayed, resulting in failing to provide aesthetic luminous display.

Also, the grids each are positioned below a surface of the phosphor layer 7, so that it fails to satisfactorily exhibit its function. This often leads to a display defect phenomenon that luminous segments desired to emit light are partially fail to carry out emission due to a negative electric field of luminous segments adjacent thereto which are not desired to emit light.

In order to solve the above-described problem of the conventional fluorescent display device due to the thick film printing, a fluorescent display device which includes a metal film pattern as shown in FIG. 3 is proposed. More specifically, in the proposed fluorescent display device, wiring conductors 12, anode conductors 15 and plane grids 16 arranged on a glass substrate 1 are formed of a metal film and phosphor layers 7 are deposited on the anode conductors 15. It is disclosed in Japanese Patent Application Laying-Open Publication No. 59639/1985.

In the proposed fluorescent display device, the metal film pattern is formed by subjecting a metal film to etching, so that a gap between luminous segments may be narrowed. However, the grids are likewise positioned below the phosphor layers, to thereby still fail to eliminate such a display defect as described above due to a negative electric field of adjacent luminous segments which are not desired to emit light. Also, the fluorescent display device has another disadvantage that light emitted from each of the luminous segments is reflected from a surface of the metal film plane grid to cause a luminous display of the device to be doubled, resulting in failing to provide the display with an aesthetic property. Further, external light is reflected from the metal film, so that contrast between the display segments and their background is reduced to deteriorate visibility of the display.

SUMMARY OF THE INVENTION

The present invention has been made in view of the foregoing disadvantage of the prior art.

Accordingly, it is an object of the present invention to provide a fluorescent display device of the plane grid type which is capable of eliminating a display defect and exhibiting high luminance to improve quality of a luminous display of the device and provide good visibility while keeping a gap between luminous segments small.

In accordance with the present invention, a fluorescent display device is provided. The fluorescent display device includes an insulating substrate, phosphor-deposited anodes arranged on the insulating substrate, grids arranged on the insulating substrate in proximity to the anodes, and filamentary cathodes stretched above the anodes. The grids each are constituted by a metal film section arranged on the substrate, an insulating layer section laminatedly arranged on the metal film section in a manner to expose a peripheral portion of the metal film section surrounding the anode and a conductive layer section laminatedly arranged on the insulating layer section. The metal film section and conductive layer section are electrically connected together via through-holes formed at the insulating layer section.

In the fluorescent display device of the present invention constructed as described above, the grid structure is formed by subjecting a metal film to etching, so that a gap between the luminous segments may be narrowed to a degree sufficient to provide displayed figures, letters or the like with good continuity. Also, the conductive layer section is arranged on the insulating layer section, resulting in being positioned above a surface of the phosphor layer. This causes the plane grids to be positioned to the cathodes to lead to a satisfactory function of the grids. Further, each of the metal film sections is covered with the insulating layer and black conductive layer section except its peripheral portion surrounding the anode, to thereby substantially prevent emission of the anode from being reflected from the metal film section.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a fluorescent display device according to the present invention will be described with reference to the accompanying drawings.

Figure 1:
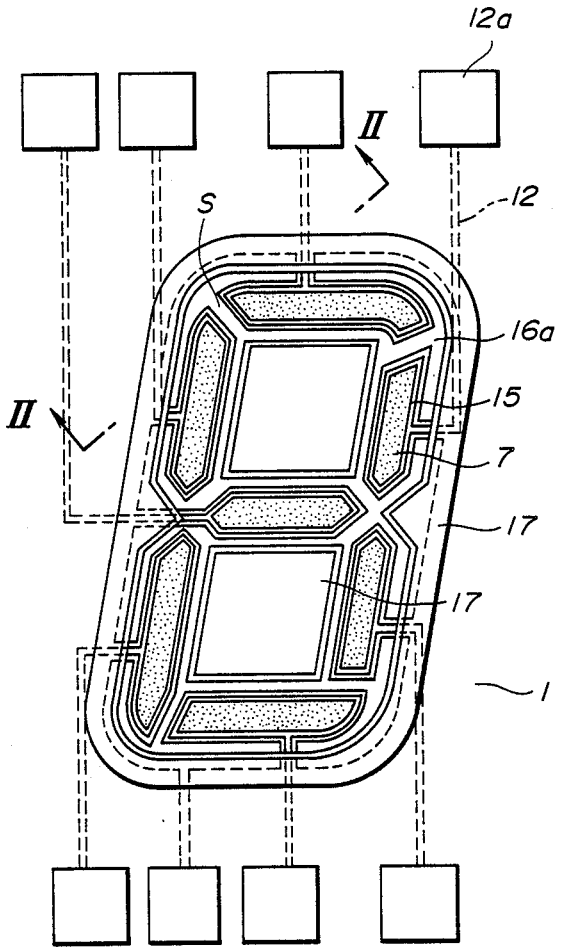
FIG. 1 is a plan view showing an essential part of a fluorescent display device according to the present invention.
Figure 2:
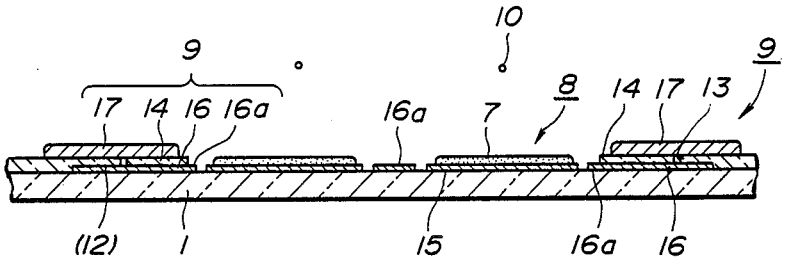
FIG. 2 is a sectional view taken along line II—II in FIG. 1.
Figure 3:
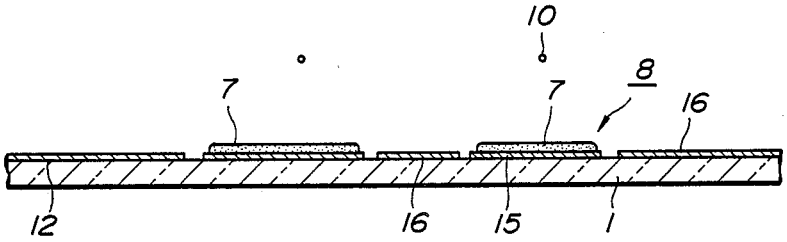
FIG. 3 PRIOR ART
FIGS. 3 and 4 each are a sectional view showing a conventional fluorescent display device of the plane grid type.
Figure 4:
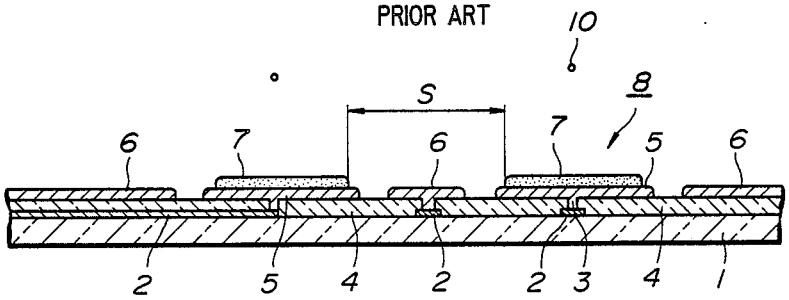
FIG. 4 PRIOR ART

FIGS. 1 and 2 illustrate an embodiment of a fluorescent display device of the present invention, wherein FIG. 1 is a plan view showing an essential part of a fluorescent display device and FIG. 2 is a sectional view taken along line II—II in FIG. 1.

The fluorescent display device of the illustrated embodiment includes an insulating substrate 1 which may be generally formed of a glass material. On a whole surface of the insulating glass substrate 1 is deposited a metal film by a suitable method such as sputtering or vapor deposition. A material for the metal film is not limited to any specific metal as long as it can be formed into a film shape and exhibit good conductivity. In the illustrated embodiment, aluminum is used for this purpose. The aluminum film is subjected to etching to form metal film sections 16 constituting anode conductors 15, wiring conductors 12 and grids 9 and terminals 12*a* for led-out lead wires connected to the wiring conductors 12 in a patterned manner on the substrate 1.

Then, a paste comprising an insulating material such as frit glass or the like and a photosensitive material added to the insulating material is deposited all over the patterned substrate 1 by thick film printing and light (ultraviolet rays) is irradiated to the paste through a mask to lead to photosetting of the paste.

Subsequently, developing is carried out to remove an uncured portion of the insulating layer. Such thick film photolithography causes the insulating material on the anode conductors 15, peripheral portions 16*a* of the metal film section 16 surrounding the anode conductors 15, through-holes 13 and lead terminals 12*a* to be removed to expose an aluminum film pattern. The residual insulating material forms insulating layer sections 14. Thick film photolithography permits a thick film pattern to be formed with high accuracy, resulting in the exposed peripheral metal film portions 16*a* around the anode conductors 15 being formed into a dimension as small as 0.1 to 0.2mm.

The substrate 1 having the so-formed insulating layer sections 14 is subjected to burning at a temperature of 450 to 550° C. in an oxidizing atmosphere, resulting in fixing of the insulating layers 14.

The insulating layer sections 14 each may be provided with a second insulating layer by thick film photolithography after the burning for the purpose of improving insulating properties of the insulating layer sections 14 and forming conductive layer sections described below at an elevated position.

Then, the through-hole sections 13 each are charged with a conductive paste material mainly consisting of Ag, resulting in being electrically connected to the metal film sections 16.

Further, a phosphor layer 7 is deposited on each of the anode conductors 15 by any conventional method such as photolithography, thick film printing, electrodeposition or the like, to thereby form an anode 8 in cooperation with the anode conductor 15.

Thereafter, a conductive paste such as, for example, a graphite paste is deposited on the insulating layer sections 14 by thick film printing to form conductive layer sections 17 for the grids 9. The conductive layer section 17 each may be arranged all over the insulating layers 14. Alternatively, it may be arranged on only a periphery of the anode 8 or an outer periphery and an inside of each of luminous segments arranged into an 8-shaped form. Such partial arrangement of the conductive layer section 17 causes a reactive current of the grids to be reduced.

Finally, on an outer periphery of the insulating substrate 1 is deposited a sealing material mainly consisting of frit glass by thick film printing and used for hermetically sealing a front casing on the substrate 1, which is then subjected to burning at 450 to 550° C. in an oxidizing atmosphere to lead to an anode substrate. Above the anode substrate are stretchedly arranged filamentary cathodes 10, and a box-like casing (not shown) is sealed on the substrate 1 to form an envelope. The envelope is then evacuated to high vacuum, resulting in the fluorescent display device.

The anode substrate of the fluorescent display device of the illustrated embodiment is formed according to the procedures described above. Thus, the anodes 8 each are constituted by the anode conductor 15 formed of the metal film deposited on the substrate 1 and the phosphor layer 7 arranged on the anode conductor 15 in a manner to be at a position inwardly spaced by 0.1 to 0.2mm from a periphery of the anode conductor 15. Also, in the illustrated embodiment, the anodes 8 are arranged into an 8-shaped form as shown in FIG. 1, thus, they are referred to as 8-shaped luminous segments.

Around each of the anodes 8 is arranged the grid 9 of a laminated structure constituted by the metal film section 16, insulating layer section 14 and conductive layer section 17, wherein the metal film section 16 is exposed at its peripheral portion **16*a* surrounding the anode 8, so that it may exhibit a grid function. Accordingly, such construction also cause the peripheral metal film portion 16*a* between the segments adjacent to each other to be exposed, resulting in it likewise exhibiting a grid function. Also, in the illustrated embodiment, the conductive layer sections 17 are arranged through the insulating layer sections 14 on the metal film sections 16 and electrically connected via the through-holes 13 to the metal film sections 16. Also, the conductive layer sections 17 each are formed by deposition of a conductive paste according to thick film printing; accordingly, in formation of the sections 17, a gap having a dimension of, for example, 0.2mm is provided in view of printing accuracy and sagging of the paste. This leads to partial exposure of the insulating layers 14. However, the grids 9 are exposed above and below the exposed portions of the insulating layers 14, so that an electric field of both grids which interpose the exposed portions of the insulating layers 14 therebetween may eliminate adverse affection due to electrons charged on the exposed portions. Thus, such construction, irrespective of the insulating layers 14** being partially exposed, effectively prevents a display defect due to an electric field of the electrons charged on the exposed portions.

Moreover, the conductive layer sections 17 are arranged at a position higher than the phosphor layers 7 or positioned to a side of the filamentary cathodes 10, so that the grids may effectively function to satisfactorily prevent a display defect as encountered in the prior art.

The above description has been made in connection with the 8-shaped display segments; however, the present invention is of course applicable to display segments other than the 8-shaped ones.

Figure 5:
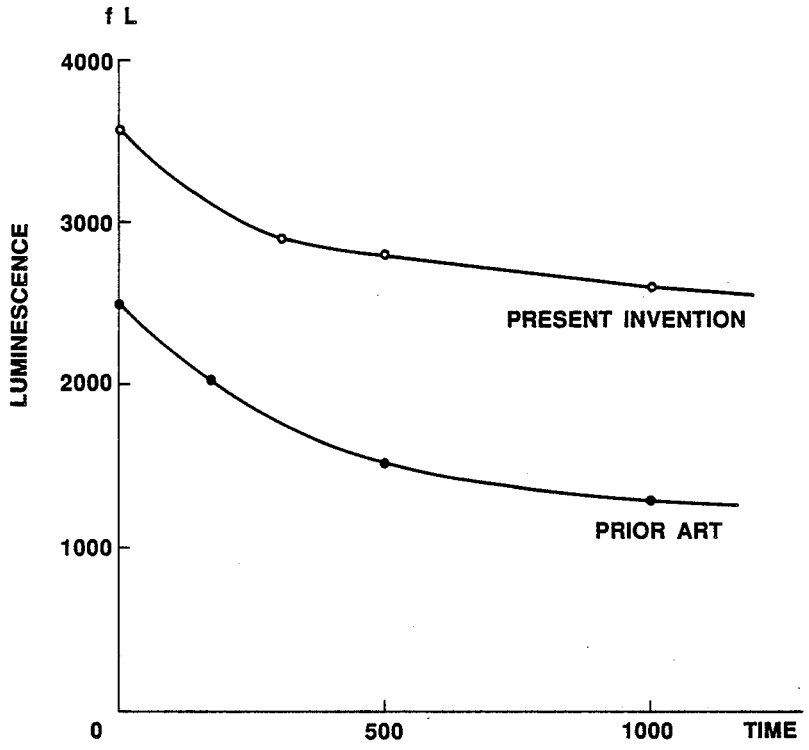
FIG. 5 is a graphical representation showing relationships between luminance and a continuous drive time in each of a fluorescent display device of the present invention and a conventional fluorescent display device.

As can be seen from the foregoing, the fluorescent display device of the present invention includes, in place of mesh-like grids, the plane grids of a three-layer structure comprising the metal film sections 16, insulating layer sections 14 and conductive layer sections 17. Such construction of the present invention exhibits excellent advantages as shown in FIG. 5. More particularly, FIG. 5 shows relationships between luminance and a continuous drive time in each of a conventional fluorescent display device of the mesh-like grid type and the fluorescent display device of the plane grid type according to the present invention which were continuously driven under the same conditions that a cathode voltage of 1.9V, an anode voltage of 36V and a grid voltage of 20V were applied at a high temperature of 85° C. for 500 hours.

The reason why the test took place at a temperature as high as 85° C. is that it is considered that a dashboard of a vehicle is subjected to a high temperature, particularly, in summer, because it is arranged in proximity to an engine. It is generally known in the art that a lifetime of a fluorescent display device is further extended when such a test is carried out at a normal temperature.

As shown in FIG. 5, the conventional fluorescent display device was 2500 fL in initial luminance, whereas that of the fluorescent display device of the present invention was 3600fL. This indicates that the present invention was increased in luminance by 44% as compared with the conventional fluorescent display device. Also, as a result of the continuous drive test, it was found that the conventional fluorescent display device reached a maximum luminance of 2000fL in about 170 hours and the luminance was then gradually decreased to 1600fL in 500 hours and 1300fL in 1000 hours, whereas luminance of the fluorescent display device of the present invention was kept at a high level and substantially uniform as is apparent from the fact that it was 2900fL in 300 hours, 2800fL in 500 hours and 2600fL in 1000 hours and kept at a level above 2000fL even after the device was subjected to a high temperature over a long period of 1000 hours. This clearly indicates that the fluorescent display device of the present invention fully meets the requirements that luminance above 2000fL is required for a head up display unit, thus, it will be noted that the present invention can be satisfactorily used for a head up display unit and exhibit excellent visibility.

Also, in the fluorescent display device of the present invention, the patterns of the anode conductors and metal film sections constituting a base of the grids are formed by subjecting a metal film to etching, so that the gap (bridge) between the display segments adjacent to each other may be formed into a width as small as 0.5mm or less even when a grid is provided at the gap. Accordingly, letters or figures displayed can be observed in a continuous manner to improve quality of the display.

Further, in the present invention, the grids each are constructed into a three-layer structure, so that both the metal film portion surrounding the anode and the conductive layer section formed at a level above the phosphor layer may exhibit a grid function, to thereby fully prevent any display defect.

In addition, the metal film sections each are covered with the insulating layer and black conductive layer section, to thereby prevent a luminous display from being doubled due to reflection of the display from the metal film section, resulting in visibility being significantly improved.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device comprising:

an insulating substrate;

phosphor-deposited anodes arranged on said insulating substrate;

grids arranged on said insulating substrate in proximity to said anodes;

filamentary cathodes stretched above said anodes;

said grids each being constituted by a metal film section arranged on said substrate, an insulating layer section laminatedly arranged on said metal film section in a manner to expose a peripheral portion of said metal film section surrounding said anode and a conductive layer section laminatedly arranged on said insulating layer section so as to be electrically connected to said metal film section.

2. A fluorescent display device as defined in claim 1, wherein electrical connection between said metal film section and said conductive layer section is carried out via through-holes formed at said insulating layer section.

3. A fluorescent display device as defined in claim 1, wherein said conductive layer section is provided in a manner to project from said anode.

* * * * *